US007765038B2

(12) United States Patent
Appleby et al.

(10) Patent No.: US 7,765,038 B2
(45) Date of Patent: Jul. 27, 2010

(54) MISSION PLANNING SYSTEM FOR VEHICLES WITH VARYING LEVELS OF AUTONOMY

(75) Inventors: Brent Appleby, Holliston, MA (US); Rosemary D. Paradis, Vestal, NY (US); Robert J. Szczerba, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 1471 days.

(21) Appl. No.: 11/058,836

(22) Filed: Feb. 16, 2005

(65) Prior Publication Data

US 2006/0184292 A1 Aug. 17, 2006

(51) Int. Cl.
*G01C 22/00* (2006.01)

(52) U.S. Cl. ..... 701/23; 701/24; 701/25; 701/28; 701/200; 318/568.1; 700/245; 73/178 R; 180/167

(58) Field of Classification Search ..... 701/3, 701/213, 2, 23–24, 120, 200; 318/568.1; 700/248–250, 235; 73/178 R; 180/167
See application file for complete search history.

(56) References Cited

U.S. PATENT DOCUMENTS 5,263,396 A 11/1993 Ladan et al.
5,631,658 A 5/1997 Gudat et al.
5,739,787 A 4/1998 Burke et al.
5,904,724 A * 5/1999 Margolin ..... 701/120
6,064,926 A 5/2000 Sarangapani et al.
6,076,030 A 6/2000 Rowe
6,122,572 A * 9/2000 Yavnai ..... 701/23
6,484,083 B1 11/2002 Hayward et al.
6,636,781 B1 * 10/2003 Shen et al. ..... 700/248
6,672,534 B2 1/2004 Harding et al.
6,718,261 B2 4/2004 Mattheyses et al.
6,842,674 B2 * 1/2005 Solomon ..... 701/23
6,847,865 B2 * 1/2005 Carroll ..... 701/3
6,904,335 B2 * 6/2005 Solomon ..... 700/247

(Continued)

FOREIGN PATENT DOCUMENTS

AU 2003262893 A8 * 11/2005

(Continued)

OTHER PUBLICATIONS

Parasuraman et al.; Human control of multiple robots in the RoboFlag simulation environment; Systems, Man and Cybernetics, 2003; IEEE; Oct. 2003; vol. 4, pp. 3232-3247. cited by other.*

(Continued)

*Primary Examiner*—Cuong H Nguyen
(74) *Attorney, Agent, or Firm*—Tarolli, Sundheim, Covell & Tummino LLP

(57) ABSTRACT

A system in accordance with the present invention tasks a team of autonomous unmanned vehicles. The system includes a first team member and a second team member. The first team member has a first level of autonomy. The second team member has a second level of autonomy. The first level of autonomy is different than the first level of autonomy. The first team member is given instructions corresponding to the first level of autonomy. The second team member is given instructions corresponding to the second level of autonomy.

10 Claims, 6 Drawing Sheets

U.S. PATENT DOCUMENTS

| | | | | |
|---|---|---|---|---|
| 6,990,406 | B2 * | 1/2006 | Fink et al. | 701/117 |
| 7,024,340 | B2 * | 4/2006 | Nichols et al. | 702/188 |
| 7,047,861 | B2 * | 5/2006 | Solomon | 89/1.11 |
| 7,236,861 | B2 * | 6/2007 | Paradis et al. | 701/24 |
| 7,299,130 | B2 * | 11/2007 | Mulligan et al. | 701/213 |
| 7,343,222 | B2 * | 3/2008 | Solomon | 700/245 |
| 7,343,232 | B2 * | 3/2008 | Duggan et al. | 701/24 |
| 7,603,212 | B2 * | 10/2009 | Ariyur et al. | 701/23 |
| 2003/0213358 | A1 | 11/2003 | Harding | |
| 2004/0030448 | A1 * | 2/2004 | Solomon | 700/245 |
| 2004/0030449 | A1 * | 2/2004 | Solomon | 700/245 |
| 2004/0030450 | A1 * | 2/2004 | Solomon | 700/245 |
| 2004/0030451 | A1 * | 2/2004 | Solomon | 700/245 |
| 2004/0030570 | A1 * | 2/2004 | Solomon | 705/1 |
| 2004/0030571 | A1 * | 2/2004 | Solomon | 705/1 |
| 2004/0068351 | A1 * | 4/2004 | Solomon | 701/24 |
| 2004/0068415 | A1 * | 4/2004 | Solomon | 705/1 |
| 2004/0068416 | A1 * | 4/2004 | Solomon | 705/1 |
| 2004/0134336 | A1 * | 7/2004 | Solomon | 89/1.11 |
| 2004/0134337 | A1 * | 7/2004 | Solomon | 89/1.11 |
| 2004/0167682 | A1 * | 8/2004 | Beck et al. | 701/3 |
| 2005/0004723 | A1 * | 1/2005 | Duggan et al. | 701/24 |
| 2005/0183569 | A1 * | 8/2005 | Solomon | 89/1.11 |
| 2005/0197749 | A1 * | 9/2005 | Nichols et al. | 701/3 |
| 2005/0240253 | A1 * | 10/2005 | Tyler et al. | 607/134 |
| 2006/0184291 | A1 * | 8/2006 | Paradis et al. | 701/23 |
| 2006/0184292 | A1 * | 8/2006 | Appleby et al. | 701/23 |
| 2007/0093946 | A1 * | 4/2007 | Gideoni | 701/24 |

FOREIGN PATENT DOCUMENTS

| | | | |
|---|---|---|---|
| EP | 2004018158 | A2 * | 8/2005 |
| JP | 2005539296 | W * | 12/2005 |
| RU | 2167380 | C2 | 5/2001 |
| WO | WO 2004018158 | A2 * | 3/2004 |

OTHER PUBLICATIONS

Goldman et al.; Macbeth: a multi-agent constraint-based planner [autonomous agent tactical planner]; Digital Avionics Systems Conf, 2002; IEEE; Oct. 2002; vol. 2, pp. 7.E.3-1 to 7.E.3-8. cited by other.*

An Information-Based Approach for System Autonomy Metrics Part I: Metrics Definition, Arie Yavnai. cited by other Architecture of a Novel Mission Controller for Advanced Unmanned Air Vehicles, Arie Yavnai. cited by other.*

Alighanbari et al.; Coordination and control of multiple UAVs with timing constraints and loitering; Proc. of the American Control Conf-Colo.; IEEE; Jun. 2003; pp. 5311-5316, cited by other.*

Gordon-Spears et al.; Reconfigurable robot teams: modeling and supervisory control; IEEE Control Systems Tech; Sep. 2004; vol. 12, No. 5, pp. 76, cited by other.*

Mapping and Tracking; Cole, D.T.; Goktogan, A.H.; Thompson, P.; Sukkarieh, S.; Robotics & Automation Magazine, IEEE vol. 16, Issue 2, Jun. 2009 pp. 22-34; Digital Object Identifier 10.1109/MRA.2009.932527.*

Decentralized Detection of a Class of Non-Abrupt Faults With Application to Formations of Unmanned Airships; Lechevin, N.; Rabbath, C.A.; Control Systems Technology, IEEE Transactions on; vol. 17, Issue 2, Mar. 2009 pp. 484-493 Digital Object Identifier 10.1109/TCST.2008.2000990.*

Assigning Micro UAVs to Task Tours in an Urban Terrain; Shima, T.; Rasmussen, S.; Gross, D.; Control Systems Technology, IEEE Transactions on; vol. 15, Issue 4, Jul. 2007 pp. 601-612; Digital Object Identifier 10.1109/TCST.2007.899154.*

Micro Unmanned Aerial Vehicle Visual Servoing for Cooperative Indoor Exploration; Rudol, P.; Wzorek, M.; Conte, G.; Doherty, P.; Aerospace Conference, 2008 IEEE; Mar. 1-8, 2008 pp. 1-10; Digital Object Identifier 10.1109/AERO.2008.4526558.*

UAV as a Reliable Wingman: A Flight Demonstration; Waydo, S.; Hauser, J.; Bailey, R.; Klavins, E.; Murray, R.M.; Control Systems Technology, IEEE Transactions on; vol. 15, Issue 4, Jul. 2007 pp. 680-688; Digital Object Identifier 10.1109/TCST.2007.899172.*

Formation flight: evaluation of autonomous configuration control algorithms; Hattenberger, Gautier; Lacroix, Simon; Alami, Rachid; Intelligent Robots and Systems, 2007. IROS 2007. IEEE/RSJ International Conference on Oct. 29, 2007-Nov. 2, 2007 pp. 2628-2633; Digital Object Identifier 10.1109/IROS.2007.4399234.*

An Intelligent Controller for Collaborative Unmanned Air Vehicles; Sinsley, G.L.; Miller, J.A.; Long, L.N.; Geiger, B.R.; Niessner, A.F.; Horn, J.F.; Computational Intelligence in Security and Defense Applications, 2007. CISDA 2007. IEEE Symposium on Apr. 1-5, 2007 pp. 139-144; Digital Object Identifier 10.1109/CISDA.2007.368146.*

Metrics, Schmetrics! How the Heck Do You Determine a UAV'S Autonomy Anyway? Bruce. T. Clough, Technical Area Leader, Air Force Research Laboratory.

* cited by examiner

| LEVEL | LEVEL DESCRIPTOR | OBSERVE PERCEPTION/SITUATIONAL AWARENESS | ORIENT ANALYSIS/COORDINATION |
|---|---|---|---|
| 10 | FULLY AUTONOMOUS | COGNIZANT OF ALL WITHIN BATTLESPACE | COORDINATES AS NECESSARY |
| 9 | BATTLESPACE SWARM COGNIZANCE | BATTLESPACE INFERENCE–INTENT OF SELF AND OTHERS (ALLIES AND FOES)<br>COMPLEX/INTENSE ENVIRONMENT–ON–BOARD TRACKING | STRATEGIC GROUP GOALS ASSIGNED<br>ENEMY STRATEGY INFERRED |
| 8 | BATTLESPACE COGNIZANCE | PROXIMITY INFERENCE–INTENT OF SELF AND OTHERS (ALLIES AND FOES)<br>REDUCED DEPENDENCE UPON OFF–BOARD DATA | STRATEGIC GROUP GOALS ASSIGNED<br>ENEMY TACTICS INFERRED – ATR |
| 7 | BATTLESPACE KNOWLEDGE | SHORT TRACK AWARENESS–HISTORY AND PREDICTIVE BATTLESPACE DATA IN LIMITED RANGE, TIMEFRAME, AND NUMBERS<br>LIMITED INFERENCE SUPPLEMENTED BY OFF–BOARD DATA | TACTICAL GROUP GOALS ASSIGNED<br>ENEMY TRAJECTORY ESTIMATED |
| 6 | REAL TIME MULTI–VEHICLE COOPERATION | RANGED AWARENESS – ON–BOARD SENSING FOR LONG RANGE, SUPPLEMENTED BY OFF–BOARD DATA | TACTICAL GROUP GOALS ASSIGNED<br>ENEMY LOCATION SENSED/ESTIMATED |
| 5 | REAL TIME MULTI–VEHICLE COORDINATION | SENSED AWARENESS – LOCAL SENSORS TO DETECT OTHERS, FUSED WITH OFF–BOARD DATA | TACTICAL GROUP PLAN ASSIGNED<br>RT HEALTH DIAGNOSIS; ABILITY TO COMPENSATE FOR MOST FAILURES AND FLIGHT CONDITIONS; ABILITY TO PREDICT ONSET OF FAILURES(E.G. PROGNOSTIC HEALTH MGMT)<br>GROUP DIAGNOSIS AND RESOURCE MANAGEMENT |
| 4 | FAULT/EVENT ADAPTIVE VEHICLE | DELIBERATE AWARENESS – ALLIES COMMUNICATE DATA | TACTICAL PLAN ASSIGNED<br>ASSIGNED RULES OF ENGAGEMENT<br>RT HEALTH DIAGNOSIS; ABILITY TO COMPENSATE FOR MOST FAILURES AND FLIGHT CONDITIONS – INNER LOOP CHANGES REFLECTED IN OUTER LOOP PERFORMANCE |
| 3 | ROBUST RESPONSE TO REAL TIME FAULTS/EVENTS | HEALTH/STATUS HISTORY AND MODELS | TACTICAL PLAN ASSIGNED<br>RT HEALTH DIAG (WHAT IS THE EXTENT OF THE PROBLEMS?)<br>ABILITY TO COMPENSATE FOR MOST CONTROL FAILURES AND FLIGHT CONDITIONS (I.E ADAPTIVE INNER–LOOP CONTROL) |
| 2 | CHANGEABLE MISSION | HEALTH/STATUS SENSORS | RT HEALTH DIAGNOSIS (DO I HAVE PROBLEMS?)<br>OFF–BOARD REPLAN (AS REQUIRED) |
| 1 | EXECUTE PREPLANNED MISSION | PRELOADED MISSION DATA<br>FLIGHT CONTROL AND NAVIGATION SENSING | PRE/POST FLIGHT BIT<br>REPORT STATUS |
| 0 | REMOTELY PILOTED VEHICLE | FLIGHT CONTROL (ATTITUDE, RATES) SENSING<br>NOSE CAMERA | TELEMETERED DATA<br>REMOTE PILOT COMMANDS |

Fig.2

MISSION PLANNING SYSTEM FOR VEHICLES WITH VARYING LEVELS OF AUTONOMY

FIELD OF INVENTION

The present invention relates to a system for mission planning of unmanned vehicles and, more particularly, to a system for autonomously commanding and controlling a team of unmanned vehicles.

BACKGROUND OF THE INVENTION

In a conventional system, an initial plan for a team of unmanned autonomous vehicles (UAVs) may be generated at the beginning of a mission as a single long chain of steps. Each of the steps may be a primitive item performed without additional calculation. When changes in an environment occur, the conventional system may require a change to some of the steps in the initial plan. The system would then redetermine the entire plan from that point on. The Replanning may take a fairly long period of time.

In a time critical environment, it may be crucial that replanning occur quickly (i.e., before catastrophic situations occur, etc.). Frequent, time-consuming replanning thus bog the conventional system down, leaving critical decisions to already overloaded human commanders. By combining a centrally controlled, deliberative model and a swarm model, timing constraints may be relaxed and flexibility of the system increased.

Another conventional planning system may direct a number of homogeneous vehicles to execute a mission plan. The complexity of the mission plan required is greatly increased when vehicles are non-homogeneous (i.e., different capacities for perception, situational awareness, analysis and decision making, as well as different communication methods, etc.).

These conventional systems rely heavily on humans to prepare mission plans and monitor execution with only limited use of planning aids. Conventional planning aids attempt automated planning by utilizing traditional models such as batch processes, sense and act procedures, etc. However, these planning aids require relatively long advance preparation time, based either on static or predicted feedback. Also, these conventional aids provide only limited ability to process complex, large dimension problems and to quickly refine or replan based on unfolding dynamic events that typically are the norm, rather than the exception, for most environments, especially urban environments.

SUMMARY OF THE INVENTION

A system in accordance with the present invention tasks a team of autonomous unmanned vehicles. The system includes a first team member and a second team member. The first team member has a first level of autonomy. The second team member has a second level of autonomy. The second level of autonomy is different than the first level of autonomy. The first team member is given instructions corresponding to the first level of autonomy. The second team member is given instructions corresponding to the second level of autonomy.

Another system in accordance with the present invention tasks a team of autonomous unmanned vehicles executing a mission plan. The system includes a planning information manager and a mission planning manager. The planning information manager updates the objectives of the mission plan. The mission planning manager determines an appropriate level of a team hierarchy to input the update.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein:

FIG. 2 is a schematic representation of example metrics for use with a system in accordance with the present invention;

DESCRIPTION OF EXAMPLE EMBODIMENTS

Figure 1:
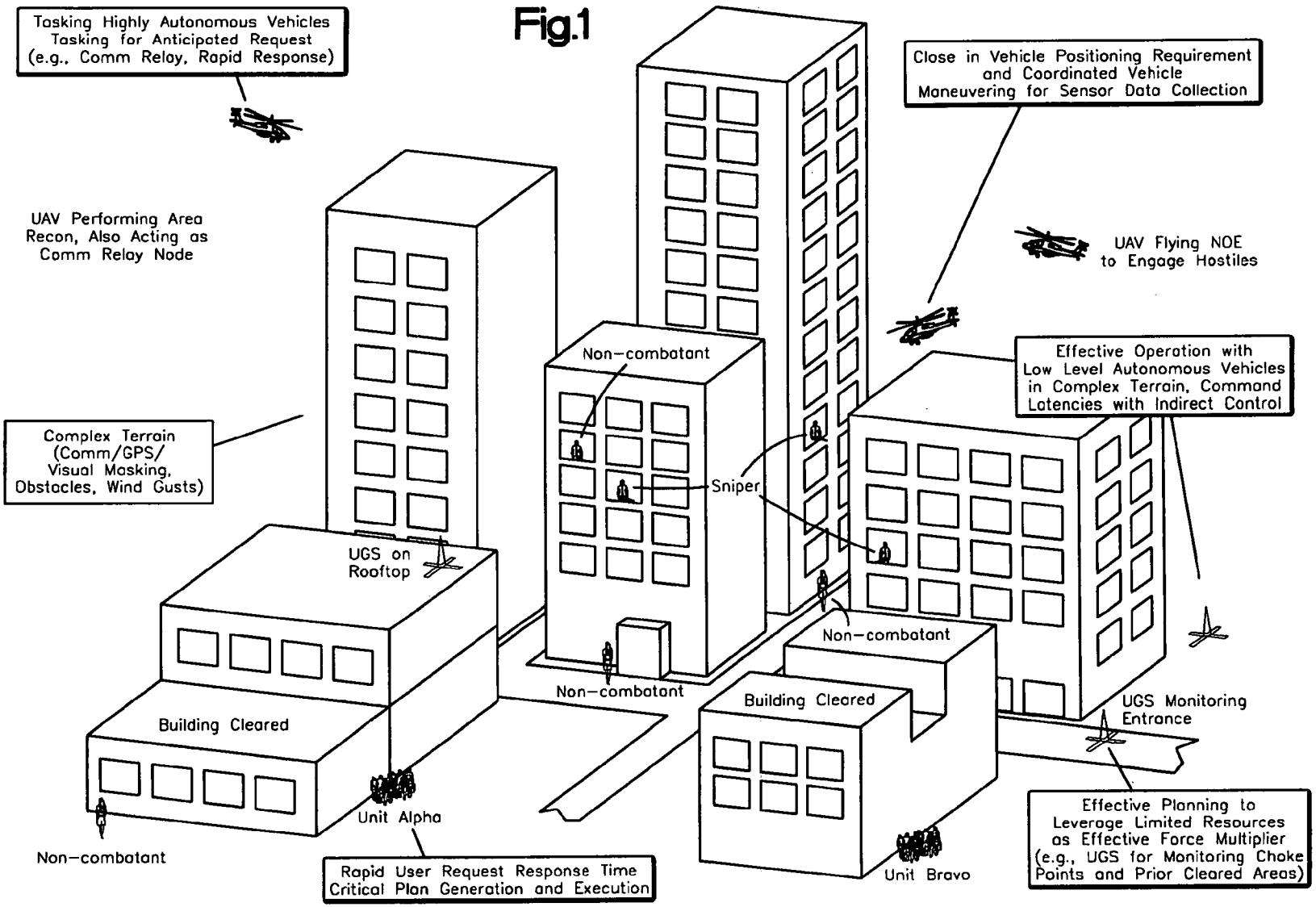
FIG. 1 is a schematic representation of an environment in which a system in accordance with the present invention may be utilized.

A system in accordance with the present invention utilizes state-of-the art components for cognitive reasoning and combines these components into a hierarchical planning system that may break apart a mission plan into a plurality of less complex sub-tasks. The system may then execute these subtasks based on techniques such as a deliberative method or a swarming method.

The system may provide mission planning for unmanned autonomous vehicles. The system may include a number of synergistic components designed to provide accurate and efficient resource allocation and dynamic mission planning capabilities for unmanned vehicles with varying levels of autonomy. The system may provide flexibility to a mission and may facilitate recovery when unmanned vehicles are lost or damaged. The system may task each vehicle at it's own level of autonomy thereby enabling each unmanned vehicle, whose capabilities may range from a low-autonomy vehicle to a highly autonomous vehicle, to operate optimally in executing its assigned task.

The system may control a team of autonomous vehicles operating in a desert, an ocean, or an urban environment, each having unique characteristics. Understanding the challenges of each environment, in particular an urban environment, may include recognition of obstacles such as high-rise buildings, friendly/hostile forces, etc. Climate considerations may also be considered while planning a mission. Some unique constraints to an urban environment may be proximity of obstacles and time constraints for enabling rapid decision-making and response planning for certain tasks.

Because of potential dangers to humans in a hazardous environment, an autonomous vehicle may enter an environment before a human. An autonomous vehicle may thus survey the environment and report back to a commander or decision maker the condition of the environment. Multiple autonomous vehicles, or teams of vehicles, may also perform this task to obtain a maximum amount of information in a given time.

The system may plan a mission involving multiple assets with varying levels of autonomy, platform diversity, and varied capabilities. For low-autonomy vehicles, the system may compensate for lack of on-board situational awareness and embedded planning capability by monitoring such items as terrain obstacles and other aircraft in the local vicinity of the low autonomy vehicle. The system may also exploit high levels of autonomy when available to ensure that maximum benefit is gained from highly capable assets.

For example, in an urban environment, the system may have a wide range of human and vehicle assets that are candidate resources for achieving mission objectives. The system may be flexible enough to consider the varied capabilities of the vehicles as well as the users who are utilizing the result of the mission plan. The system further may optimize collaboration between the unmanned vehicles and human users for continually improving mission plan execution.

Military operations in hostile and constantly changing environments, more common as battle theatres, are complex and dangerous for a warfighter. The flexible mission planning system of the present invention accounts for such environments.

Key goals for the system may be: (1) improvement of support for the warfighters in the environment; (2) providing efficient means for commanders to plan missions; and (3) providing commanders with a capability for plan monitoring and real-time refinements of plan execution.

The mission planning and control system for unmanned autonomous vehicles may provide a tool for reducing the risk to, and improving the effectiveness of, forces operating in any environment, including the more complex urban environment. FIG. 1 shows an example environment with some of the challenges present in an urban environment. The callout boxes in FIG. 1 highlight the planning and control challenges associated with an example urban Reconnaissance, Surveillance, and Target Acquisition (RSTA) mission.

An example mission may comprise a number of human units and a warfighter. Typically, the human units encounter a high risk of exposure to sniper fire. The environment may be an Innercity Urban Terrain Zone (IUTZ). The objective of the human units is to clear the zone of hostiles. The warfighter may request current imagery in advance of its intended route, with particular interest in rooftop and open windows with line of sight to a near term route. The warfighter may also request updates on which buildings have been cleared in a local area. The human units may have PUMA (Hand-Launch Pointer with side-scan camera) unmanned autonomous vehicles collecting imagery of building windows. For, example, the PUMA may be a model constructed by AeroVironment, Inc. The human units also may deposit Unattended Ground Sensors (UGS) at key entrances to buildings for monitoring access points to already cleared buildings, as well as at corners of rooftops with good lines of visibility to neighboring buildings and intersections. An Unmanned Air Vehicle (UAV) team of unmanned vehicles may sweep the IUTZ to provide wider area coverage, communication relay, and rapid response to unforeseen hostilities or other changes to the IUTZ.

The mission planning and control system for unmanned autonomous vehicles may have a wide range of, not only unmanned vehicles, but also human warfighters that may complete tasks in order to meet mission objectives. The system may be adaptive (i.e., contingency management, etc.), but also flexible enough to consider the different capabilities of the unmanned vehicles and the human units.

As stated above, for low-autonomy unmanned vehicles, the system may compensate for lack of on-board situational awareness and embedded planning capability by designating these unmanned vehicles as terrain obstacles and other aircraft in the IUTZ. The system may respond to a large number of user requests, as well as schedule tasks, with optimal usage of a large pool of resources. This situation provides any system with a complexity challenge for time-critical responses.

The system in accordance with the present invention may orchestrate the activities of multiple vehicles, insuring effective and safe operation, with minimal interference to mission plan execution. Thus, the system facilitates the most effective operation of each unmanned vehicle in executing its assigned tasks.

The availability of multiple RSTA assets enables the system to maximize synergy among a team of unmanned vehicles in achieving results of higher quality, greater reliability, and/or greater speed than would be available by independently tasking of the same set of unmanned vehicles. Further, this system may task a team of multiple autonomous unmanned vehicles having varying levels of autonomy.

The system may task multiple teams of unmanned vehicles at a team-to-team level, thereby reducing complexity and accelerating new mission plan generation. The system may task heterogeneous unmanned vehicles thereby exploiting synergy among diverse vehicle capabilities. The system may form/reform teams dynamically thereby allowing continuity of mission plan execution in the face of changing assets and resources.

Autonomous vehicles available at any one time during a mission typically have different levels of ability. Autonomous Control Levels (ACL) of these vehicles may range from no mobility to the capability to have integrated, multiple actions. FIG. 2 shows example metrics for measuring autonomy of the unmanned vehicles available for an example mission.

A system in accordance with the present invention may be hierarchical in nature, decomposing high level mission goals, such as "Find the sniper in the NE area of the city" into lower level route planning, communication relays, and sensor subtasks. The system may allow communication of a planning system decision and corresponding control logic to a platform/control station's embedded planning (if any) to be executed at any level of the hierarchy. This further allows the system to task vehicles varying from high levels of autonomy to vehicles with simple waypoint flight control.

The system may ensure the appropriate use of air assets. Because the system includes as much information as is available regarding the mission, and provides this information to mission participants, the system allows close coordination between friendly air and ground forces. The coordination may thus lead to optimal use of theater assets to enable optimal attainment of mission objectives.

In order to plan a mission with the capability to use multiple vehicles with varying levels of autonomy, the system requires information about a commander's intent for the mission, the mission plan, and the types of vehicles that will be available for a particular mission. In order to accomplish a task, the system may view all vehicle capabilities, and optimize what functions each vehicle, or group of vehicles is performing for the success of the mission. The vehicle or vehicles that are chosen to execute a particular task may be dynamic.

For example, a certain number of vehicles may start out in a team of vehicles performing a task based on their capabilities and availability. However, if a vehicle is lost, destroyed, or called out to participate in another mission, the system may task other vehicles, whose capabilities may not be as optimal as those initially selected, to perform the remaining task.

Two conventional paradigms typically control design of multi-agent systems, a deliberative agent paradigm with central control and a swarm paradigm having simple agents and distributed control. The system in accordance with the present invention may utilize a hybrid of these two paradigms. The flexibility to utilize either paradigm may be controlled by an operator/commander in the initial plan composition, or by the system itself.

Some autonomous vehicles may have many intelligent features, such as the ability to reason, negotiate, and plan action. Complex tasks may be executed either individually or collaboratively with teams of these vehicles. If collective behavior is required, in a deliberative environment, then the system (i.e., a central controller) may coordinate group behavior.

The system may monitor capabilities and the state of each vehicle, and determine which agent should be used for a particular task. In some cases, with some of the vehicles having higher levels of autonomy, collaboration between vehicles may be achieved without central control of the system (i.e., these vehicles are capable of knowing the capabilities and states of the other vehicles, etc.).

The system may form a group of lower capability vehicles into a swarm organization. In this case, the system may not direct the behavior of the swarm of vehicles, rather a collective behavior may emerge from local interactions between the vehicles and the environment. Swarms may offer several advantages over a traditional paradigm based on the deliberative vehicles with central control. Swarms may be robust and flexible enough to modify behavior based on changing environmental and team conditions.

Swarms may also be somewhat more scalable and adaptable—increasing the number of vehicles in the swarm or tasks performed by the swarm. Also, lower capability vehicles may be less likely to fail than higher capability vehicles. Further, if lower capability vehicles fail, they may be easily replaced with another vehicle that requires little information to begin operation.

Figure 3:
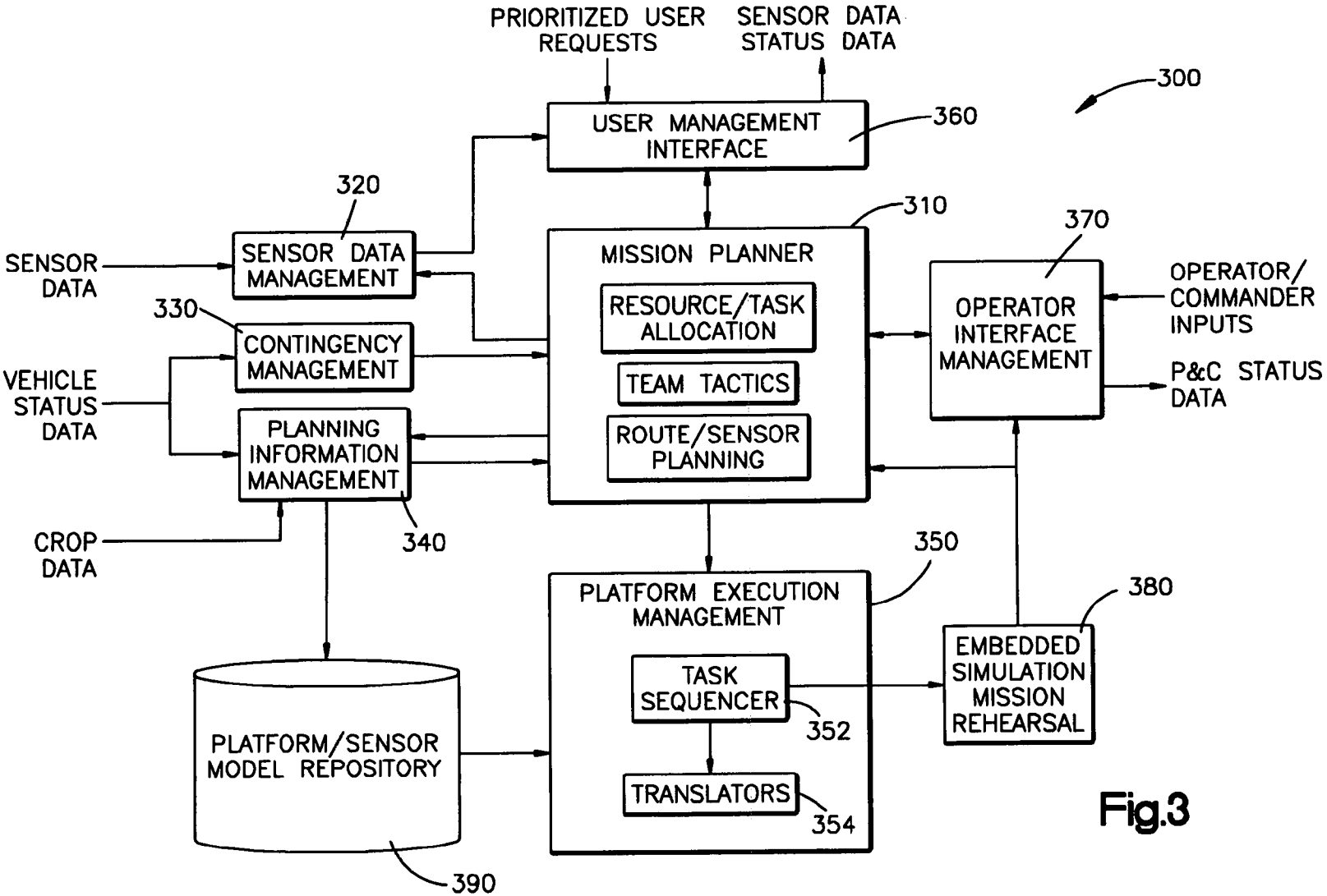
FIG. 3 is a schematic representation of an example system in accordance with the present invention.

In order to control a team of unmanned vehicles with varying levels of autonomy, an example system 300 in accordance with the present invention may include a number of synergistic functional components designed to provide accurate and efficient resource allocation and dynamic mission planning capability. As shown in FIG. 3, such components may include a Mission Planner 310, a Sensor Data Manager 320, a Contingency Manager 330, a Planning Information Manager 340, a Planning Execution Manager 350, a User Interface Manager 360, an Operator Interface Manager 370, an Embedded Simulator 380, a Platform/Sensor Model Repository 390, etc.

The Mission Planner 310 may determine an optimal resource allocation and tasking in response to asynchronous user requests. The Sensor Data Manager 320 may coordinate, schedule, and optimize the distribution of received sensor data to the various users in response to asynchronous user requests.

The Contingency Manager 330 may autonomously monitor the status of mission execution from the health and status of the individual vehicles, the status of individual plans, to the status of the collaborative mission plan. The Planning Information Manager 340 may extract information from actual mission plans, as well as external resources, and translate the information into a necessary format to be used by the other mission planning components. The Platform Execution Manager 350 may enable a planned mission to be evaluated, simulated, and detailed through tasking of various vehicle platforms. This may include the use of data from the Platform Modeling Repository 390, a Task Sequencer 352, a Vehicle Platform Translator 354, and links to the Embedded Simulator 380 for plan assessment and mission rehearsal.

The User Interface Manager 360 may provide the interface between the system 300 and an end user in the field. For example, multiple users may asynchronously task the system 300 for a variety of requests.

The Operator Interface Manager 370 may provide an interface between the system 300 and an operator. An operator (i.e., a commander, etc.) may input instructions and/or high-level mission constraints. Additionally, an operator may monitor execution of the mission plan and intercede at any level of the planning hierarchy, if desired.

The Embedded Simulator 380 may provide a realistic simulation model to evaluate candidate plans, produce performance metrics, and/or provide feedback to an operator and/or mission commander for plan refinement and mission rehearsal.

The Platform/Sensor Model Repository 390 may store realistic models used for various platforms and sensors in a mission environment. The Repository 390 may generally be populated from outside the system 300, but maintained within the system.

Figure 4:
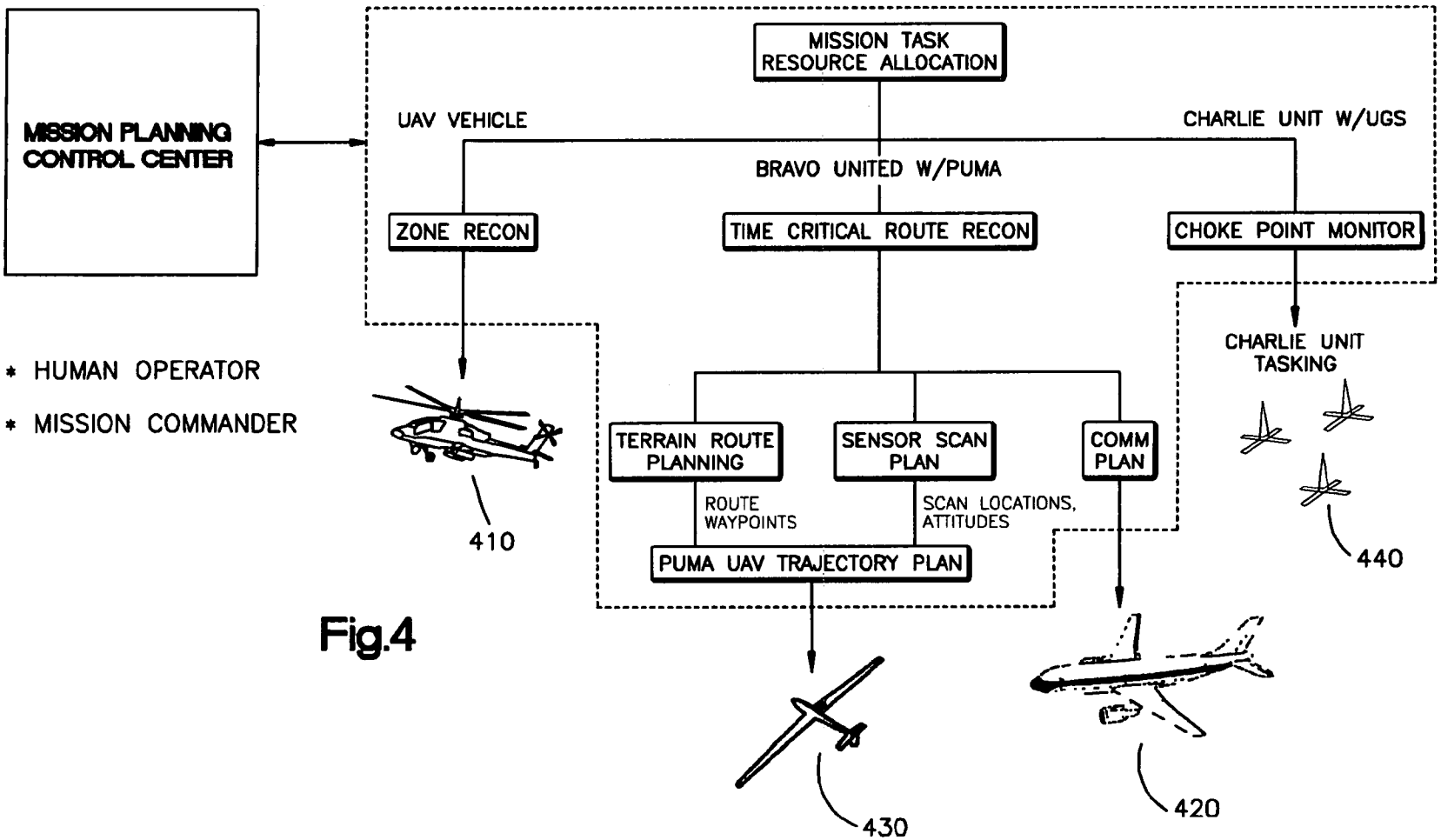
FIG. 4 is a schematic representation of another example system in accordance with the present invention.

Another example system 400 in accordance with the present invention may task different assets at different levels of a task hierarchy (FIG. 4). Multiple autonomous unmanned vehicles may be available to the system 400—a UAV 410, Silver Fox 420, a Puma 430 and/or several UGS 440. The UAV (Unmanned Combat Armed Rotorcraft) 410 may have a high level of autonomy and may perform tasks without a detailed agenda. The Silver Fox 420 may have GPS autopilot and downward looking Electro-Optic/Infrared (EO/IR) sensors and may develop it's own trajectory plan. For example, the Silver Fox may be a model constructed by Advanced Ceramics Research, Inc.

A PUMA 430 may be an urbanized pointer with GPS autopilot and daylight camera housings and may require more specific task and trajectory commands. The Unattended Ground Sensors (UGS) 440 may exist in various sizes and forms, contain several sensor technologies, be deployed by several means, and report information on or about different types of targets.

The UAV 410 may not require lower level tasking, but may merely be given the general task "Zone Recon". The UGS, because of their lower functional capability, may also be tasked at this level with a single general criteria "Choke Point Monitor". These two tasks may be at the same level of a hierarchical decomposition because these tasks may be at the same command level for each UAV.

The PUMA 430 may be given waypoints and other low-level data to accomplish its task. The Silver Fox 430 may require a communication plan. Each UAV may be given the right level of detail that is required to accomplish its task in the overall mission plan.

A mission plan may be to enter a town and survey the state of the environment and conditions, set up monitoring stations for additional information, and neutralize ground threats before human soldiers enter the area. In this example, there may be a number of unmanned vehicles in a pool of autonomous vehicles that may be available for use by a mission planner. The mission planner may then lay out mission tasks, and, in order to generate a detailed task hierarchy, may then optimize the use of the vehicles that are available.

For example, assume Vehicle 1 and Vehicle 2 may both check out the interior of a particular building and send back the information, but Vehicle 2 may also remove foreign sensors after the building search is completed. Also, assume that there are multiple sensor devices available that require placement in strategic areas in order to collect the information. There may be several ways to accomplish this task to place the sensors.

The system may optimize the use of the available equipment, and then give a device the instructions that are the minimal set of instructions that the device or vehicle requires. This minimal set of instructions depends on position in the tasking hierarchy. These instructions may also change based on changing conditions, requests, and/or the addition or removal of vehicles or sensors.

Figure 5:
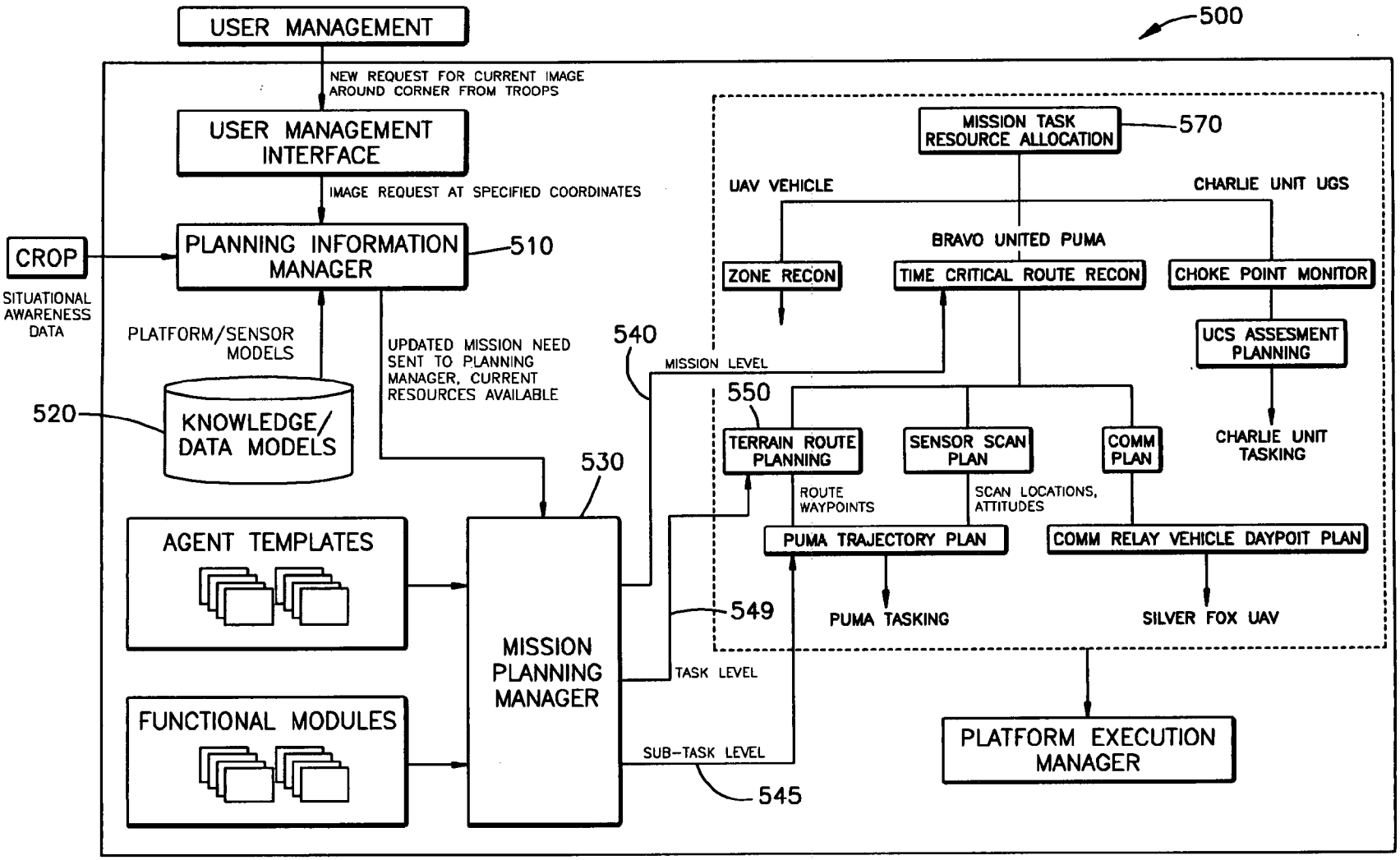
FIG. 5 is a schematic representation of still another example system in accordance with the present invention.

FIG. 5 shows an implementation of a new user request by another example system 500 in accordance with the present invention. The request is read by a Planning Information Manager 510, which may update planning objectives stored in a Knowledge Repository 520 and also send a notification of the new request to a Mission Planning Manager 530.

The Mission Planning Manager 530 will then determine if an existing planning agent may be modified or if a new agent must be created. The Mission Planning Manager 530 also may coordinate the mapping of the input requests to the appropriate level of the planning hierarchy, attempting to respond at the lowest level to avoid unnecessary replanning activity at a higher mission level (e.g., recomputing team composition and assigned reconnaissance area zones, etc.) for each team.

Figure 6:
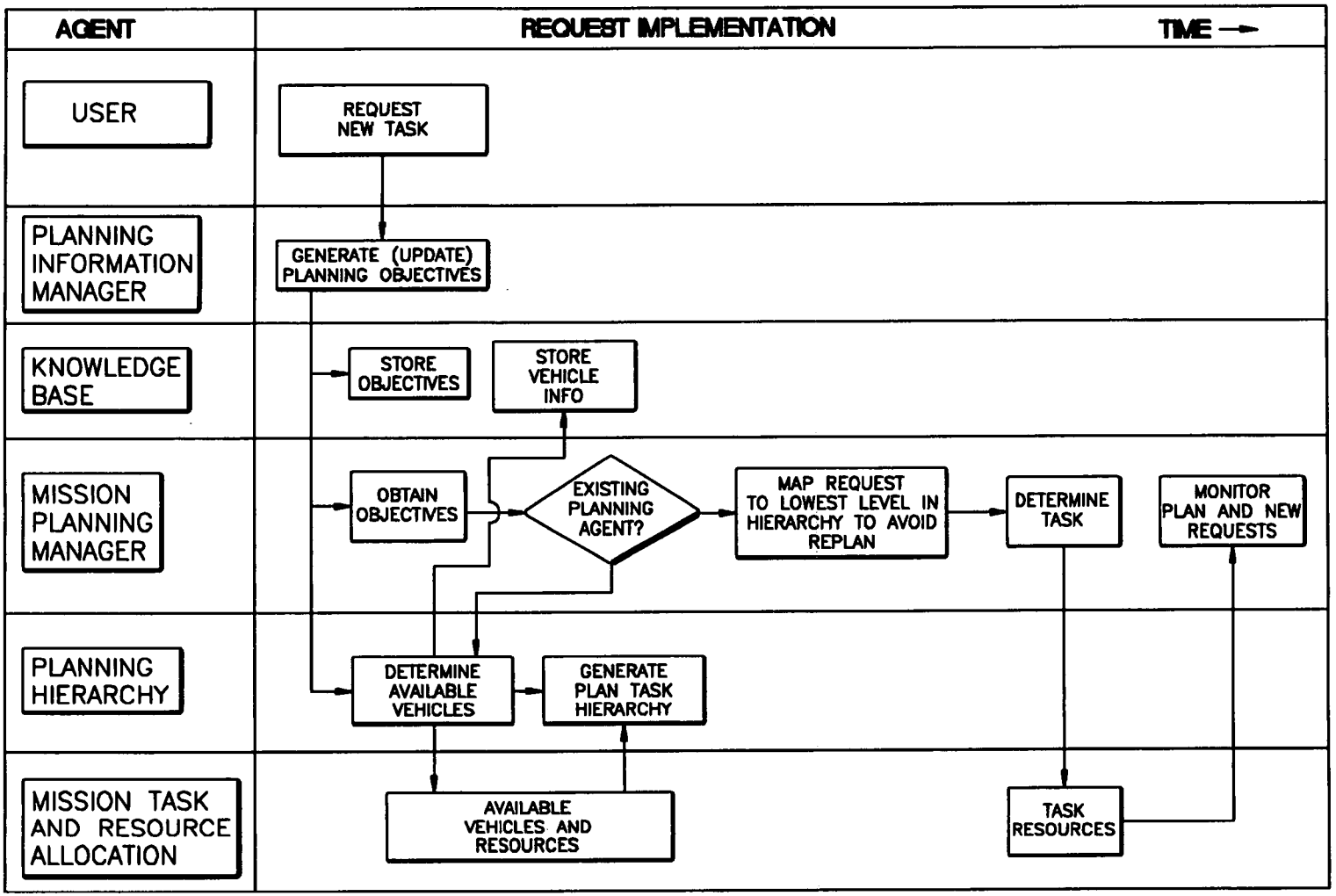
FIG. 6 is an example of operation of a system in accordance with the present invention.

In this example, the Mission Level 540 and Sub Task Level 545 paths are not chosen; rather, the Task Level 549 path to a Terrain Route Planner 550 is selected to add an extra waypoint in a vehicle route. The path from a Mission Task and Resource Allocator 570 shows this. FIG. 6 shows an example of monitoring an incoming request and determination of what type of information should be sent to a vehicle.

In order to provide a context for the various aspects of the present invention, the following discussion is intended to provide a brief, general description of a suitable computing environment in which the various aspects of the present invention may be implemented. While the invention has been described above in the general context of computer-executable instructions of a computer program that runs on a computer, those skilled in the art will recognize that the invention also may be implemented in combination with other program modules.

Generally, program modules include routines, programs, components, data structures, etc. that perform particular tasks or implement particular abstract data types. Moreover, those skilled in the art will appreciate that the inventive methods may be practiced with other computer system configurations, including single-processor or multiprocessor computer systems, minicomputers, mainframe computers, as well as personal computers, hand-held computing devices, microprocessor-based or programmable consumer electronics, and the like. The illustrated aspects of the invention may also be practiced in distributed computing environments where tasks are performed by remote processing devices that are linked through a communications argument model. However, some, if not all aspects of the invention can be practiced on standalone computers. In a distributed computing environment, program modules may be located in both local and remote memory storage devices.

An exemplary system for implementing the various aspects of the invention includes a conventional server computer, including a processing unit, a system memory, and a system bus that couples various system components including the system memory to the processing unit. The processing unit may be any of various commercially available processors. Dual microprocessors and other multi-processor architectures also can be used as the processing unit. The system bus may be any of several types of bus structure including a memory bus or memory controller, a peripheral bus, and a local bus using any of a variety of conventional bus architectures. The system memory includes read only memory (ROM) and random access memory (RAM). A basic input/output system (BIOS), containing the basic routines that help to transfer information between elements within the server computer, such as during start-up, is stored in ROM.

The server computer further includes a hard disk drive, a magnetic disk drive, e.g., to read from or write to a removable disk, and an optical disk drive, e.g., for reading a CD-ROM disk or to read from or write to other optical media. The hard disk drive, magnetic disk drive, and optical disk drive are connected to the system bus by a hard disk drive interface, a magnetic disk drive interface, and an optical drive interface, respectively. The drives and their associated computer-readable media provide nonvolatile storage of data, data structures, computer-executable instructions, etc., for the server computer. Although the description of computer-readable media above refers to a hard disk, a removable magnetic disk and a CD, it should be appreciated by those skilled in the art that other types of media which are readable by a computer, such as magnetic cassettes, flash memory cards, digital video disks, Bernoulli cartridges, and the like, may also be used in the exemplary operating environment, and further that any such media may contain computer-executable instructions for performing the methods of the present invention.

A number of program modules may be stored in the drives and RAM, including an operating system, one or more application programs, other program modules, and program data. A user may enter commands and information into the server computer through a keyboard and a pointing device, such as a mouse. Other input devices (not shown) may include a microphone, a joystick, a game pad, a satellite dish, a scanner, or the like. These and other input devices are often connected to the processing unit through a serial port interface that is coupled to the system bus, but may be connected by other interfaces, such as a parallel port, a game port or a universal serial bus (USB). A monitor or other type of display device is also connected to the system bus via an interface, such as a video adapter. In addition to the monitor, computers typically include other peripheral output devices (not shown), such as speaker and printers.

The server computer may operate in a networked environment using logical connections to one or more remote computers, such as a remote client computer. The remote computer may be a workstation, a server computer, a router, a peer device or other common network node, and typically includes many or all of the elements described relative to the server computer. The logical connections include a local area network (LAN) and a wide area network (WAN). Such networking environments are commonplace in offices, enterprise-wide computer networks, intranets and the internet.

When used in a LAN networking environment, the server computer is connected to the local network through a network interface or adapter. When used in a WAN networking environment, the server computer typically includes a modem, or is connected to a communications server on the LAN, or has other means for establishing communications over the wide area network, such as the internet. The modem, which may be internal or external, is connected to the system bus via the serial port interface. In a networked environment, program modules depicted relative to the server computer, or portions thereof, may be stored in the remote memory storage device. It will be appreciated that the network connections shown are exemplary and other means of establishing a communications link between the computers may be used.

In accordance with the practices of persons skilled in the art of computer programming, the present invention has been described with reference to acts and symbolic representations of operations that are performed by a computer, such as the server computer, unless otherwise indicated. Such acts and operations are sometimes referred to as being computer-executed. It will be appreciated that the acts and symbolically represented operations include the manipulation by the processing unit of electrical signals representing data bits which causes a resulting transformation or reduction of the electrical signal representation, and the maintenance of data bits at memory locations in the memory system (including the system memory, hard drive, floppy disks, and CD-ROM) to thereby reconfigure or otherwise alter the computer system's operation, as well as other processing of signals. The memory locations where such data bits are maintained are physical locations that have particular electrical, magnetic, or optical properties corresponding to the data bits.

The presently disclosed embodiments are considered in all respects to be illustrative, and not restrictive. The scope of the invention is indicated by the appended claims, rather than the foregoing description, and all changes that come within the meaning and range of equivalence thereof are intended to be embraced therein.

Having described the invention, we claim:

1. A system for tasking a team of a plurality of unmanned vehicles executing a mission plan, each of the plurality of unmanned vehicles having an associated set of resources and an associated level of autonomy, said system comprising:

a planning information manager configured to receive the mission plan, translate information from the mission plan into a desired format, and provide updates of objectives to the mission plan;

a mission planner configured to receive the formatted information from the planning information manager, formulate a plurality of mission tasks from the formatted information, and determine an optimal allocation of a selected set of the plurality of unmanned vehicles to the plurality of mission tasks according to the respective associated resources and level of autonomy of the plurality of unmanned vehicles; and a user interface manager configured to communicate a set of instructions to each of the selected set of the plurality of unmanned vehicles, the set of instructions for each unmanned vehicle comprising a minimum set of instructions associated with the level of autonomy of the unmanned vehicles.

2. The system as set forth in claim 1 wherein said mission planner transmits the update to a mission task resource allocator.

3. The system as set forth in claim 1 wherein said mission planning manager transmits the update to a choke point monitor.

4. The system as set forth in claim 1 wherein said mission planning manager transmits the update to a terrain route planner.

5. The system as set forth in claim 1 wherein said mission planning manager transmits the update to a trajectory planner.

6. The system as set forth in claim 1 further including an embedded simulator for modeling a candidate mission plan.

7. The system as set forth in claim 1 further including a repository for storing realistic models.

8. The system as set forth in claim 1 further including an operator interface manager for monitoring execution of the mission plan.

9. The system as set forth in claim 1 further including a platform execution manager for evaluating the mission plan.

10. The system as set forth in claim 9 wherein said platform execution manager has a task sequencer and a vehicle platform translator.

* * * * *